US005622570A

United States Patent [19]

Lima et al.

[11] Patent Number: 5,622,570

[45] Date of Patent: Apr. 22, 1997

[54] PROCESS FOR REMOVING ACCUMULATED MELTABLE MATTER IN PIPES BY MEANS OF A HEATED TRAVELLING ELEMENT

[75] Inventors: Paulo Cesar R. Lima; Carmem Silvia D. D. Lobato; Carlos Alberto Saliba, all of Rio de Janeiro, Brazil

[73] Assignee: Petroleo Brasileiro S.A. - Petrobras, Rio de Janeiro, Brazil

[21] Appl. No.: 305,369

[22] Filed: Sep. 13, 1994

[30] Foreign Application Priority Data

Sep. 13, 1993 [BR] Brazil ..... PI9303772

[51] Int. Cl.[6] ..... B08B 7/00; C23G 1/00

[52] U.S. Cl. ..... 134/5; 134/2; 134/6; 134/8; 134/19; 134/22.11; 134/22.12; 134/22.19; 134/23; 134/24; 134/34; 134/35; 134/36; 134/40

[58] Field of Search ..... 134/2, 5, 6, 8, 134/19, 22.11, 22.12, 22.19, 23, 24, 34, 35, 36, 40; 138/97, 98

[56] References Cited

U.S. PATENT DOCUMENTS

| | | | |
|---|---|---|---|
| 2,415,729 | 2/1947 | Dana | 134/5 |
| 2,744,880 | 5/1956 | Brown | 134/8 |
| 2,906,650 | 9/1959 | Wheaton | 134/8 |
| 3,108,012 | 10/1963 | Curtis | 134/8 |
| 3,344,078 | 9/1967 | Graham et al. | 252/157 |
| 3,489,689 | 1/1970 | Tao et al. | 134/35 |
| 4,416,703 | 11/1983 | Scott | 134/8 |
| 4,473,408 | 9/1984 | Purinton | 134/8 |
| 4,759,579 | 7/1988 | Swenson | 294/19.1 |
| 4,950,446 | 8/1990 | Kinumoto et al. | 214/516 |

*Primary Examiner*—Jan H. Silbaugh
*Assistant Examiner*—Robin S. Gray
*Attorney, Agent, or Firm*—Sughrue, Mion, Zinn, Macpeak & Seas

[57] ABSTRACT

A process for removing accumulated meltable matter from a pipe includes introducing inside a pipe a cylindrical travelling element or pig made of low density, high elasticity foam. A mixture of reagents which, after a certain period of time will cause a highly exothermic reaction to occur, is introduced inside the pig so that by displacing the pig the meltable deposits within the pipe will melt and will be carried by the pig to a place from which they will be removed together with the pig.

8 Claims, 3 Drawing Sheets

PROCESS FOR REMOVING ACCUMULATED MELTABLE MATTER IN PIPES BY MEANS OF A HEATED TRAVELLING ELEMENT

FIELD OF THE INVENTION

1. Background of the Invention

This invention concerns a process to remove accumulated matter inside a pipe, which can be melt to be later dragged by a travelling element flowing inside the pipe. It applies specifically in the use of a polymeric cylindrical element moved by the drive of a flowing liquid.

This travelling element (from now on referred to as a pig) is heated by means of a chemical reaction or through a physical-chemical effect.

2. Prior Art

Inside a pipe in which there is a flow of liquid products, deposits are created which reduce the effective liquid flow area and bring problems to said flow. These problems are all the more serious when it is crude oil or its refined products which flow through these pipes, specifically over large distances. To remove or clean such deposits, it is very common to introduce at a certain point an object or device (named a pig) which fits into the pipe internal dimensions. This pig is moved by the fluid (liquid or gas) pressure, flowing (preferably at a high speed) and dragging (scraping) the detritus to a place in which they are removed together with the "travelling" object. However, such a process presents certain drawbacks concerning the shape and constitution of the "travelling" device. One of the most serious drawbacks for the device is the lack of clearance with the inner pipe wall. Since the device (or pig) is designed to scrap these walls, there is a risk that it will be confined or destroyed. These problems may require the pipe disassembly for the removal of the pig.

More recently pigs or scrapers have been designed which are made of a polymeric foam, which is of very low density as compared to the existing foams. This can be seen in U.S. Pat. No. 5,389,155 in which, besides being of reduced costs, it allows the devices to be introduced and to flow in pipes subject to large diameter variations, thanks to their large elasticity and wear resistance.

In the case of paraffinic oils, when there is a paraffinic wax accumulation on the walls, it would appear as an immediate solution to the pipe (or, more specifically to oil pipeline) operators to cause their melting by means of a local heating. However, to succeed in heating such a pipe is sometimes not an easy task, since, in general , one deals with large extension pipes in which the acccumulation points are not easily accessible.

The prior art has made very little progress in this field, except in very few cases of electrical heating at points of easy access and, even so, in small extensions, although not covering the specific pipeline case. So, basically, in the prior art the attempt to remove the accumulated product in pipes has concentrated on the strong mechanical action of highly abrasive scrapers, of rather complicated designs, including brushes or bristles of high strength, even metal-made scrapers, as is known in the art.

SUMMARY OF THE INVENTION

The present invention presents the application of a process for the "in situ" heating of deposits that can be made to melt (specially paraffinic wax) and their later drag by means of a pig.

The passage of polymeric foam pigs as described in U.S. Pat. No. 5,389,155 of the Applicant and herein fully incorporated by reference, causes the withdrawing of the condensate liquid in gas pipelines, the foam pigs being propelled through the pipeline by a small pressure difference between the trailing part of the foam pig and the front part of the foam pig, so that the displacement of the foam pig along the interior surfaces of the pipeline pushes the gas condensate. The polymeric foam pigs (made of low density, high elasticity polyurethane) as described in U.S. Pat. No. 5,389,155 are deformed by the impelling fluid pressure and are able to take the shape of the inner surface of the pipes.

The referred to pigs, made of polymeric foam, can behave as chemical substance carriers, which through their reactions or under the effect of certain physical-chemical processes, cause local heating in critical points, where a plug is formed due to the accumulation of organic solid meltable matter.

BRIEF DESCRIPTION OF THE DRAWINGS

The objectives of the invention will be more readily perceived from the following detailed description given with reference to the accompanying drawings, in which.

PREFERRED EMBODIMENTS

Figure 1:
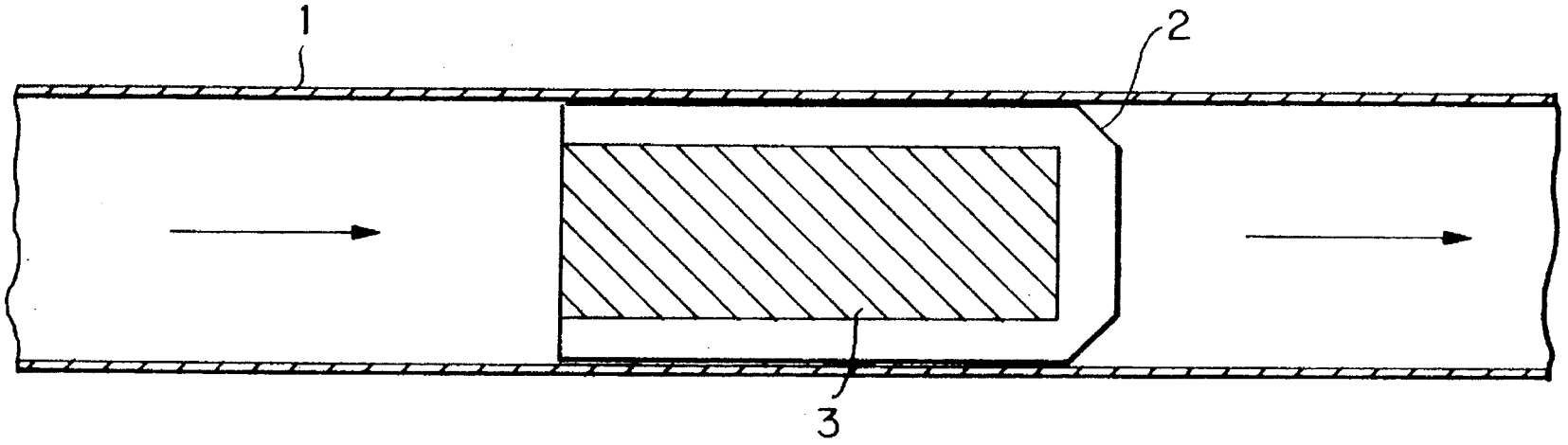
FIG. 1 shows a simplified cut-away view of a simple pig, carrying the components that will cause heating and the ensuing cleaning.

Referring to FIG. 1, we can see a nearly cylindrical pig made of a low density and high elasticity foam, containing a cavity inside, in which there is a mixture which will cause a highly exothermal reaction to occur. In operation, the reagent 3 is put inside the cavity of pig 2, and same is put inside the pipe 1 to follow its path, while pressure is applied by the flowing fluid on the back of the pig. The foam is deformed, in view of its already mentioned characteristic, fitting perfectly well into the internal wall dimensions, while the reaction of the chemical reagent 3 that is contained in pig 2 produces a strong heat. If there is no blocking in the pipe, the heat generated will be dissipated during the long path of pig 2. If there is any retention caused by the accumulation of an undesirable meltable material, pig 2 will stop flowing or will reduce its speed, concentrating the released heat on the plugging material. After a certain time, the plugging material will be molten, freeing the way for the pig's path, as the following liquid continues to exert pressure on the back side of the pig. Considering that the pig is perfectly fit to the pipe (due to the properties of the material of which the pig is made), there will be a momentary blocking, with an increase in pressure releasing the pig and dragging the plugging material molten by the action heat. The reason for this is that the pig is highly elastic, as demonstrated in practical applications, since the pig, due to its manufacture itself cannot get definitely retained.

Figure 2:
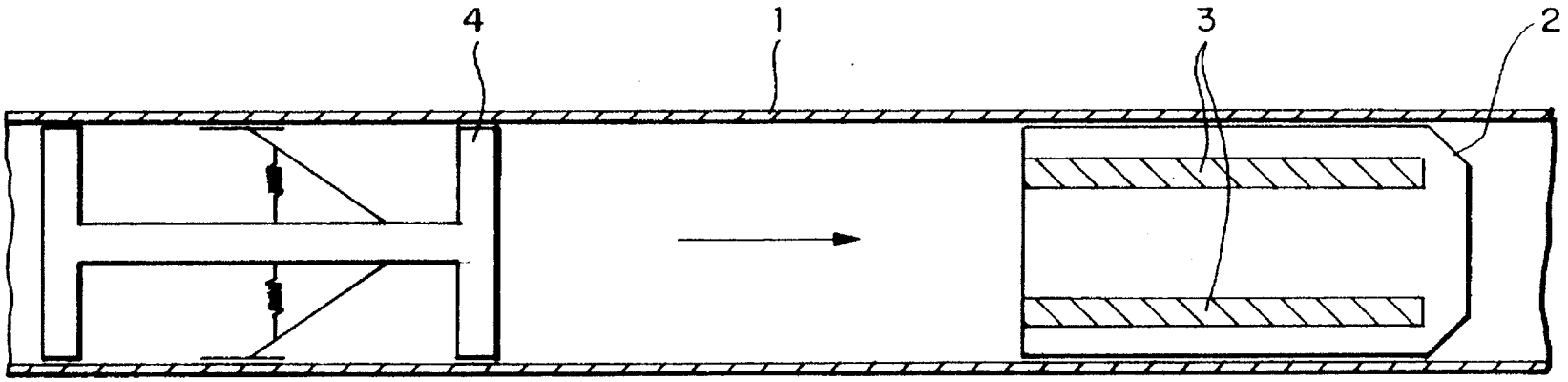
FIG. 2 shows, also in a cut-away view, another product such as that of FIG. 1, but introducing a cleaning auxiliary pig following the first one.

In FIG. 2, the cavity (or "bag") for holding the reagents 3 that will react to produce heat inside pig 2, is of annular shape, which is predicted on the use of reagent mixtures of large heat capacity. As can be seen, this is recommended when the material to be removed requires a more intense heat application. In this case, the conventional scraper 4 will be introduced behind pig 2 and inside the pipe. This scraper, the design of which is not defined here, will aid in the removal of the undesirable material, displaced by melting. This approach, as suggested hereinbefore, is designed for the most dramatic cases in which the pig efficacy is not sufficient for the desired removal, and due to the pig characteristics that do not allow its retention in the pipe, the amount of the displaced material cannot be removed in one single pig cycle.

Figure 3:
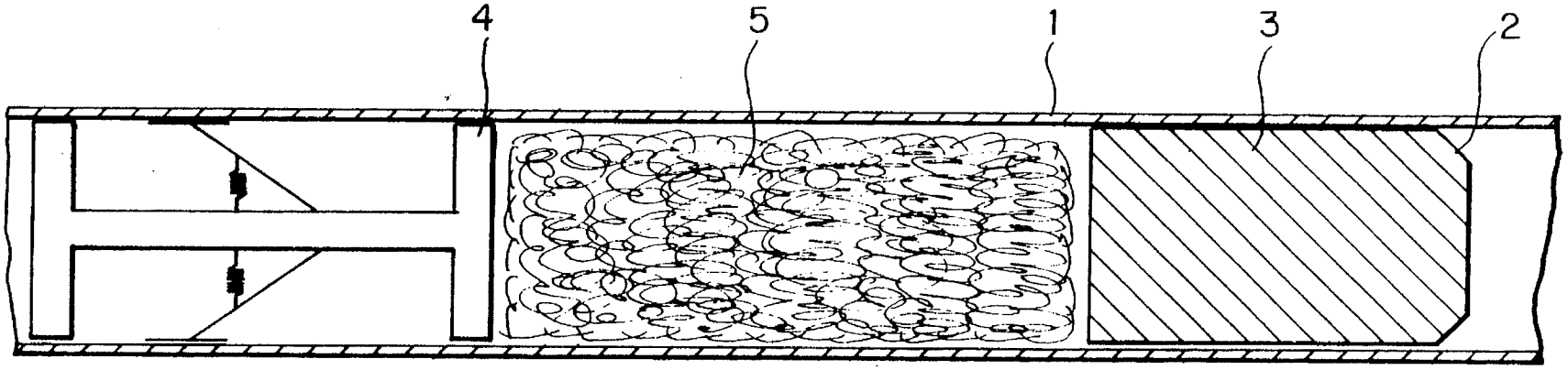
FIG. 3 shows a more complex embodiment based on that shown on FIG. 1, but provided with means for cases of more severe removal.

In FIG. 3 is shown an embodiment which aims at first to remove the meltable plugging material (e.g. paraffin wax) in large extensions. In this case, the reagents 3 which produce the exothermal reaction are soaked in the inner part of pig 2 pores.

Behind the pig 2 is formed an area which constitutes a real piston (or bed) of chemical material 5 which can either dissolve the molten plugging material or produce a heat release, followed by a conventional scraper 4.

Here, backing the pig as the main element, a pipe cleaning "train" is formed similar to the gelled piston trains, although having nothing in common with previous state-of-the-art trials.

As for the heat producing reagent, there are several chemical specialized aspects to be recommended, but the choice is highly dependent on the nature of the material carried in the pipe as well as the local availability.

So, among the possibilities one can mention, not in any way as a constraint to the present request: the reaction of an ammonium salt with a nitrite, an isocyanate reacted with a foam forming component, a catalytic reaction between a phenol and an aldehyde, water addition for dissolution of calcium chloride or zinc chloride, reaction of water with calcium oxide to form dead lime, and so on.

In case there is an immediate possibility of putting reagents in the pipe to begin the displacement, the component addition can be definitely made when same are introduced in the pig cavity. In case any travel time is predicted before the beginning of the exothermal reaction, components could stay in separate and conditioned containers, side by side (e.g. in plastic bags), easy to be discarded, which will be disrupted when the pressure is abnormally high and when plugging arises, thus starting the exothermal reaction.

The details given above should not be construed as a limitation of our process, but rather is a hint to the experts regarding one embodiment of the invention.

In any way, the examples given here are absolutely not limiting, the invention being limited only by the claims attached thereto, since several modifications can be introduced which do not conflict with the scope and spirit of the invention.

We claim:

1. A process for removing accumulated meltable residue in a pipe by means of a heated travelling element, said travelling element being a cylindrical pig made of a low density, high elasticity polymeric foam comprising: adding reagents to the pig which, by chemical reaction or physical-chemical modification, causes a highly exothermal reaction which generates heat within said pig to provide a heated pig, introducing the heated pig, immediately after adding the reagents, into the pipe and displacing said heated pig by means of a flowing fluid under pressure so that, by displacement of the heated pig, the meltable residue accumulated within said pipe is melted by the heat generated by the highly exothermal reaction and said melted residue is carried by the heated pig to an opening of the pipe for removal with the heated pig.

2. A process, according to claim 1, wherein the reagents are added inside a cylindrical cavity within the pig.

3. A process, according to claim 1, wherein the reagents are added inside a cylindrical annular cavity in the pig.

4. A process, according to claim 1, wherein the pig has a body with pores and further comprising soaking the pig with the reagents to fill the pores of the body of the pig.

5. A process according to claim 1, further comprising introducing a scraper into the pipe immediately after said heated pig which contains the reagents which cause the exothermal reaction.

6. A process according to claim 5, further comprising introducing an intermediate bed comprised of the reagents into the pipe subsequent to introducing the heated pig into the pipe and prior to introducing the scraper into the pipe to provide a cleaning train.

7. A process according to claim 1, wherein the reagents are contacted with each other upon adding the reagents to the pig immediately prior to introducing the heated pig into the pipe.

8. A process according to claim 1, further comprising packing the reagents in containers, adding the containers to the pig and rupturing the containers by pressure immediately after the containers are added to the pig.

* * * * *